US009935383B2

(12) United States Patent
Li

(10) Patent No.: US 9,935,383 B2
(45) Date of Patent: Apr. 3, 2018

(54) CABLE CONNECTOR ASSEMBLY

(71) Applicant: Molex, LLC, Lisle, IL (US)

(72) Inventor: Zhen-Liang Li, Dongguan (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/392,406

(22) Filed: Dec. 28, 2016

(65) Prior Publication Data

US 2017/0214158 A1 Jul. 27, 2017

(30) Foreign Application Priority Data

Jan. 27, 2016 (CN) ..... 2016 2 0082815 U

(51) Int. Cl.

| | |
|---|---|
| ***H01R 12/53*** | (2011.01) |
| ***H01R 4/02*** | (2006.01) |
| ***H01R 13/652*** | (2006.01) |
| ***H01R 13/717*** | (2006.01) |
| ***H01R 13/506*** | (2006.01) |

(52) U.S. Cl.

CPC ..... *H01R 12/53* (2013.01); *H01R 4/023* (2013.01); *H01R 13/506* (2013.01); *H01R 13/652* (2013.01); *H01R 13/7172* (2013.01); *H01R 13/7175* (2013.01)

(58) Field of Classification Search

CPC ..... H01R 12/53; H01R 13/7172; H01R 13/7175; H01R 13/506; H01R 13/652

See application file for complete search history.

(56) References Cited

U.S. PATENT DOCUMENTS

| | | | | |
|---|---|---|---|---|
| 7,168,975 | B2 * | 1/2007 | Kuo | H01R 13/641 439/490 |
| 7,217,142 | B1 * | 5/2007 | Wu | H01R 13/5804 439/607.41 |
| 7,247,046 | B1 * | 7/2007 | Wu | H01R 13/6691 439/490 |
| 7,429,188 | B2 * | 9/2008 | Wu | H01R 13/7172 439/490 |
| 7,632,134 | B2 * | 12/2009 | Su | H01R 13/44 439/490 |

(Continued)

FOREIGN PATENT DOCUMENTS

| | | |
|---|---|---|
| CN | 2612104 Y | 4/2004 |
| TW | I448016 B | 8/2014 |

*Primary Examiner* — Harshad C Patel
(74) *Attorney, Agent, or Firm* — Jeffrey K. Jacobs

(57) ABSTRACT

An assembly has a connector, a circuit board, a cable, a light pipe, and an outer casing. The connector has an insulating body with conductive terminals fixed therein. The circuit board is behind the connector, is electrically connected with two conductive terminals, and has two light-emitting elements. The cable has a plurality of wires, and the conductive terminal is electrically connected with the wire. An inside of the light pipe is formed with a first receiving cavity that receives the connector and the circuit board therein. The outer casing has first and second insulating casings which are latched to each other and are combined to form a second receiving cavity. The light pipe is received in the second receiving cavity and is partially exposed out of the outer casing. Light from the light-emitting elements emits outwardly via the light pipe. The cable extends rearward out of the outer casing.

10 Claims, 6 Drawing Sheets

(56) References Cited

U.S. PATENT DOCUMENTS

| | | | | |
|---|---|---|---|---|
| 7,841,892 | B2 * | 11/2010 | Zhou | H01R 13/5845<br>439/455 |
| 8,124,496 | B2 * | 2/2012 | Su | H01R 13/7175<br>438/449 |
| 2008/0003881 | A1 * | 1/2008 | Wu | H01R 13/5808<br>439/607.41 |
| 2013/0040470 | A1 * | 2/2013 | Gao | H01R 13/508<br>439/39 |
| 2015/0333440 | A1 * | 11/2015 | Zhu | H01R 13/6205<br>439/39 |

* cited by examiner

CABLE CONNECTOR ASSEMBLY

RELATED APPLICATIONS

This application claims priority to Chinese Application No. 201620082815.3, filed Jan. 27, 2016, which is incorporated herein by reference in its entirety.

TECHNICAL FIELD

The present disclosure relates to a cable connector assembly, and more specifically relates to a cable connector assembly with an indication function via emitted light.

BACKGROUND ART

Chinese patent application CN200720139276.3 discloses a cable connector assembly, the cable connector assembly comprises an insulating body, a plurality of terminals, a printed circuit board, a cable and an outer casing. The insulating body is provided with a plurality of receiving channels which penetrate the insulating body; the terminal is received in the receiving channel of the insulating body; the printed circuit board is assembled on the insulating body and is provided with a light-emitting diode; the cable is electrically connected with the printed circuit board; the outer casing is assembled on the insulating body and covers the insulating body, the printed circuit board and an end of the cable. The cable connector assembly further comprises a status indication means, the status indication means is assembled in the outer casing, the status indication means comprises a first light pipe and a second light pipe, the second light pipe is integrally formed in the outer casing and is partially exposed out of the outer casing, the first light pipe transmits the light which is generated by the light-emitting diode to the second light pipe, so as to indicate whether the electrical connection status is normal from the outside of the cable connector assembly. Such a cable connector assembly in the prior art needs to stack the first light pipe above the light-emitting diode, and a front outer casing of the outer casing is fixed on the insulating body by a pair of pins, and a rear outer casing of the outer casing is molded around an outer periphery of the second light pipe and receives the second light pipe, the structure of the cable connector assembly is complex and assembling of the cable connector assembly is not convenient.

SUMMARY

A technical problem to be resolved by the present disclosure is to provide a cable connector assembly whose structure is simple and whose assembling is convenient so as to overcome the deficiencies existing in the prior art.

In view of the above technical problem, the present disclosure provides a cable connector assembly comprising: a connector which has an insulating body and a plurality of conductive terminals fixed in the insulating body; a circuit board which is provided behind the connector, is electrically connected with at least two of the conductive terminals, and is provided with at least one light-emitting element; a cable which has a plurality of wires, the conductive terminal is electrically connected with the wire; a light pipe, the inside of the light pipe is formed with a first receiving cavity, the first receiving cavity receives the connector and the circuit board therein; and an outer casing, the outer casing comprises a first insulating casing and a second insulating casing which are latched each other, the first insulating casing and the second insulating casing are combined to form a second receiving cavity. The light pipe is received in the second receiving cavity and is partially exposed out of the outer casing; light emitted from the light-emitting element is able to emit outwardly via the light pipe; the cable extends rearward out of the outer casing.

In some embodiments, the light pipe is in a hollow cylindrical shape, a front edge of the light pipe is exposed out of a front end of the outer casing.

In some embodiments, the first insulating casing and the second insulating casing face each other in a front-rear direction, two sides of the first insulating casing each are provided with at least one elastic latching arm extending towards the second insulating casing, the second insulating casing is provided with at least two latching holes each corresponding to the elastic latching arm.

In some embodiments, the light pipe is clamped between the first insulating casing and the second insulating casing in the front-rear direction, the light pipe is provided with a stop portion which protrudes outwardly behind the front edge of the light pipe and is stopped by the first insulating casing.

In some embodiments, an inner wall of the first receiving cavity of the light pipe is attached to the light-emitting element.

In some embodiments, the light-emitting element is a LED.

In some embodiments, the circuit board is provided with two solder pads, the conductive terminals of the connector comprise a power terminal and a grounding terminal which are directly soldered on the two solder pads respectively.

In some embodiments, the wires of the cable are directly soldered on the conductive terminals of the connector.

In some embodiments, the connector further comprises a shielding shell sheathed on an outer periphery of the insulating body, the shielding shell is provided with a grounding soldering leg extending rearward; one wire of the cable is directly soldered on the grounding soldering leg.

In some embodiments, a protective case is molded around an outer periphery of the circuit board, the protective case wraps up at least joint of the wires, the conductive terminals and the circuit board therein, and the light-emitting element is exposed out of the protective case.

Compared with the prior art, in the present disclosure, the light pipe is sheathed on the outer periphery of the connector, the circuit board, and the outer casing formed by the first insulating casing and the second insulating casing which are latched each other is sheathed on the outer periphery of the light pipe, the structure of the cable connector assembly is simple and the assembling of the cable connector assembly is convenient.

DETAILED DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Hereinafter, an embodiment of the present disclosure will be further described in detail in combination with figures.

Figure 1:
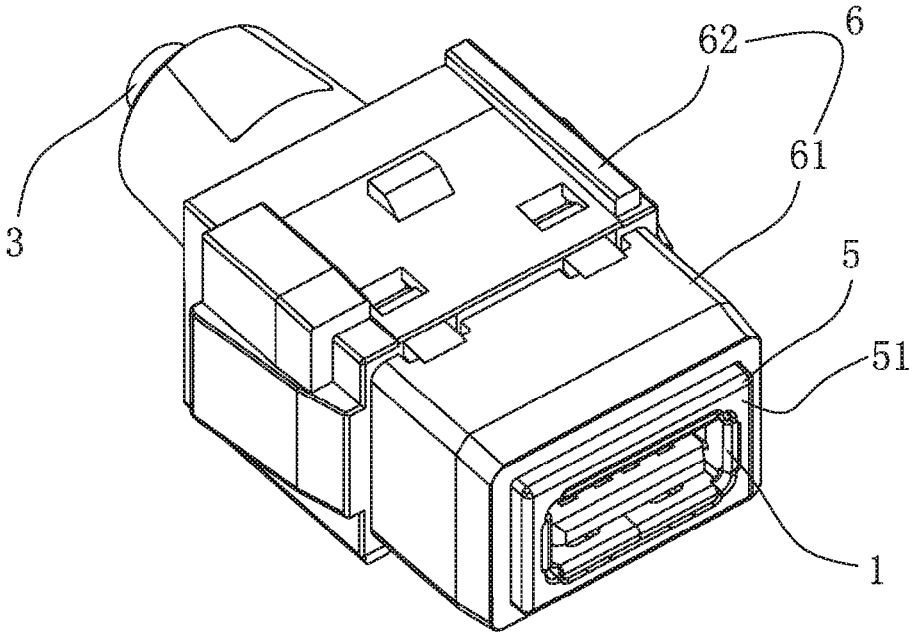
FIG. 1 is a perspective view of an embodiment of a cable connector assembly of the present disclosure.
Figure 2:
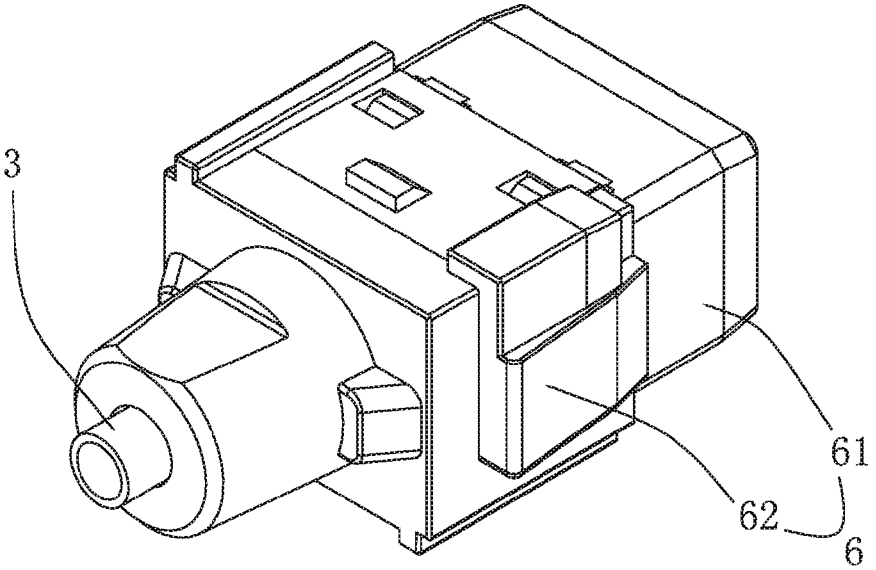
FIG. 2 is a perspective view of the embodiment of the cable connector assembly of the present disclosure viewed from another angle.
Figure 3:
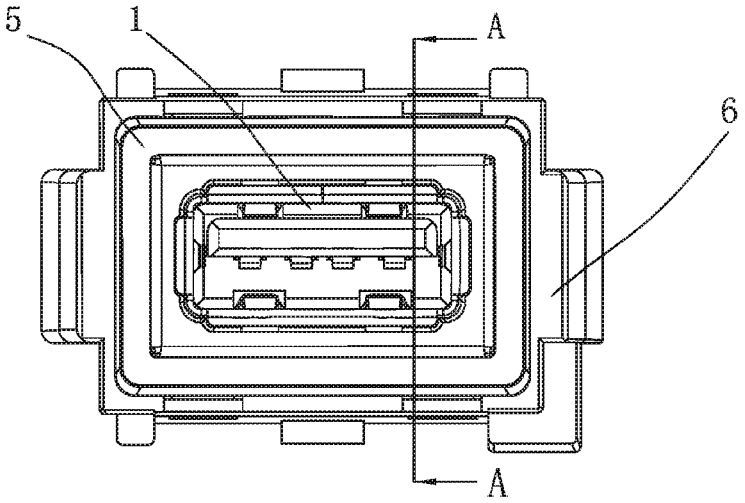
FIG. 3 is a front view of the embodiment of the cable connector assembly of the present disclosure.
Figure 4:
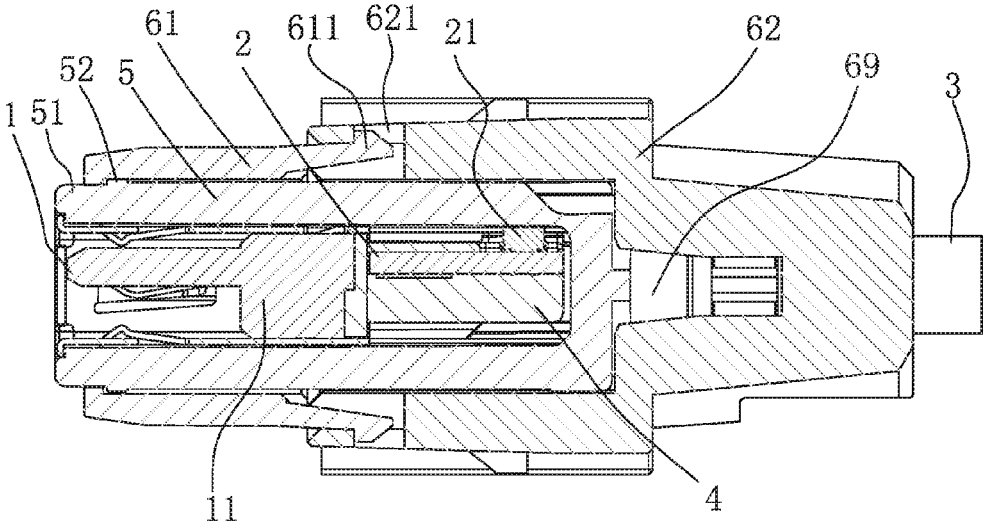
FIG. 4 is a cross sectional view taken along a line A-A of FIG. 3.
Figure 5:
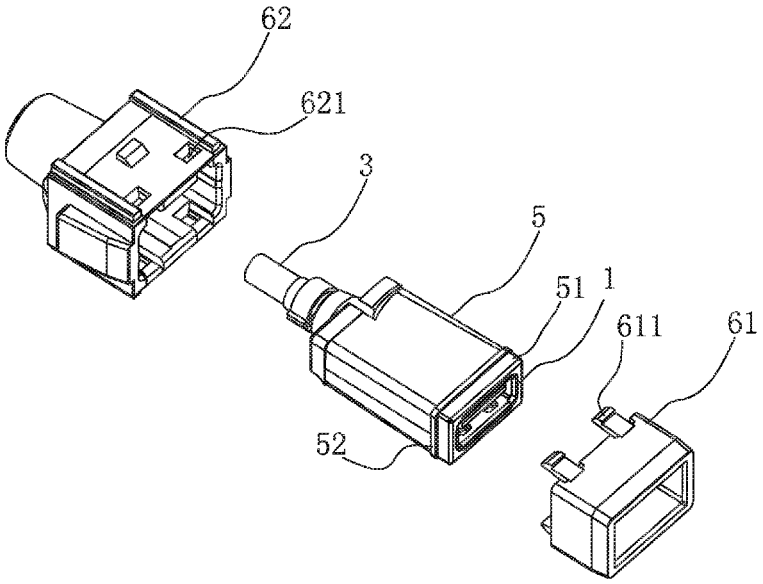
FIG. 5 is an exploded perspective view of the embodiment of the cable connector assembly of the present disclosure.
Figure 6:
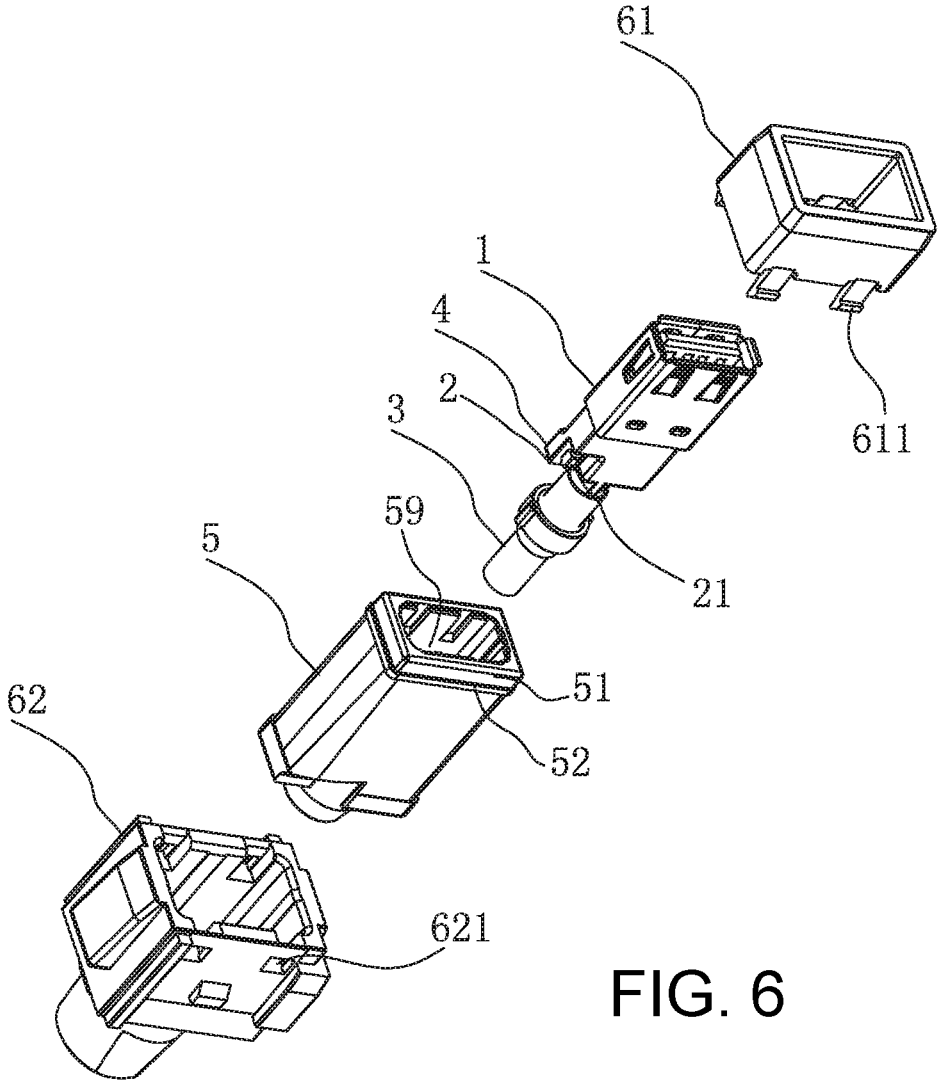
FIG. 6 is a further exploded perspective view of FIG. 5.
Figure 7:
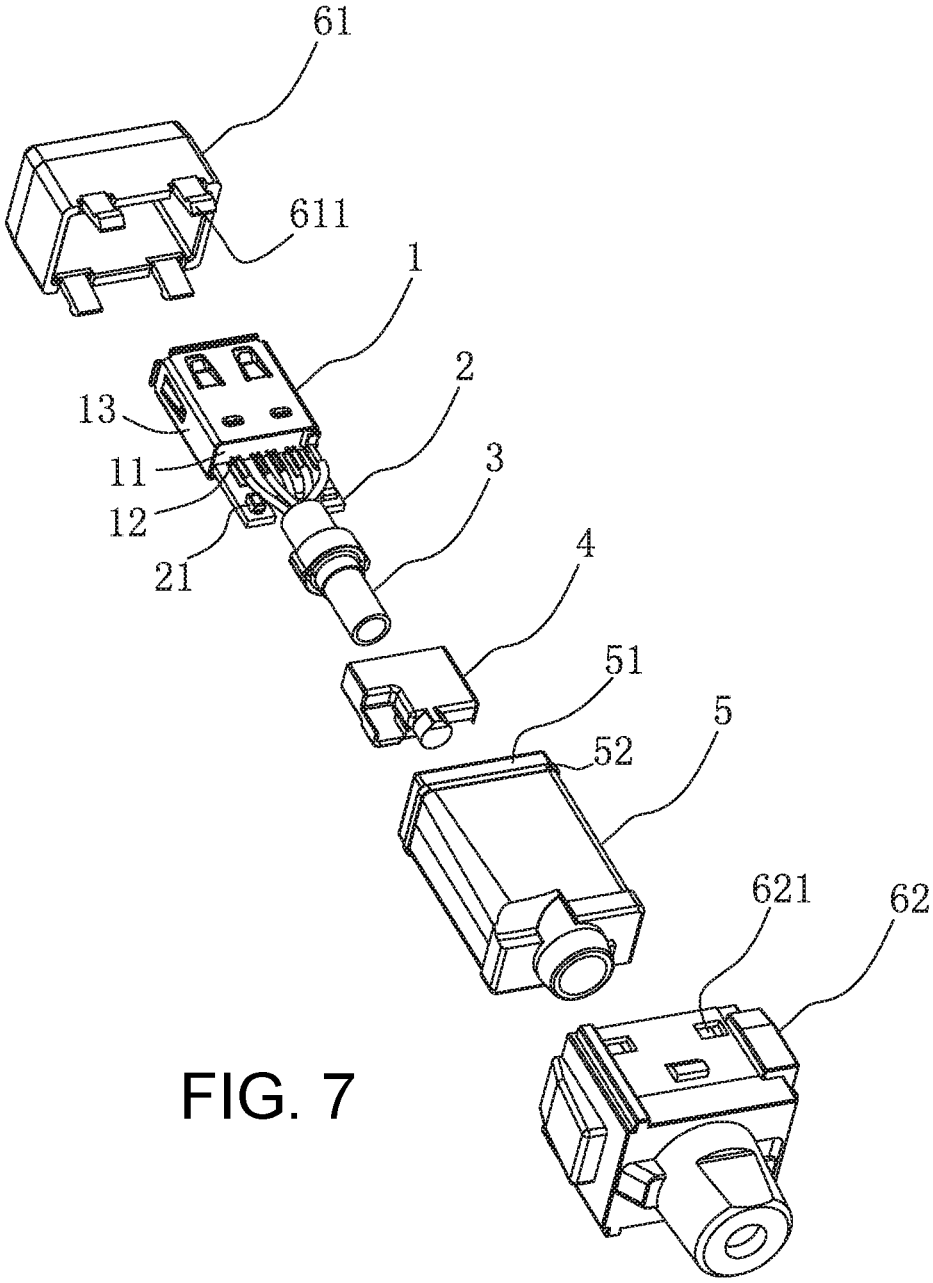
FIG. 7 is a further exploded perspective view of FIG. 6.
Figure 8:
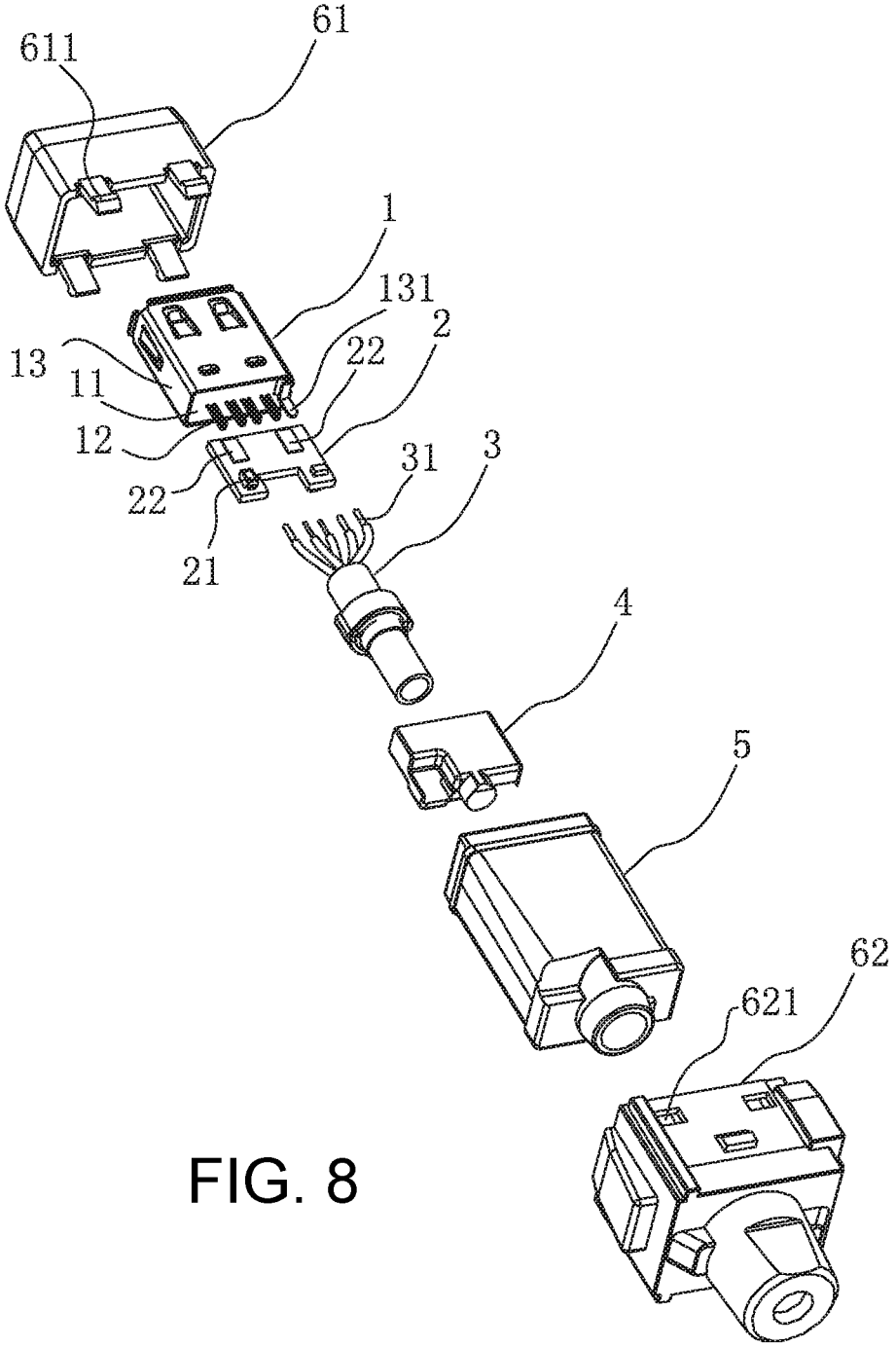
FIG. 8 is a further exploded perspective view of FIG. 7.

Referring to FIG. 1 to FIG. 8, the present disclosure provides a cable connector assembly, an embodiment is described by taking a USB cable connector assembly capable of emitting light as example, the cable connector assembly comprises: a connector 1, a circuit board 2 electrically connected with the connector 1, a cable 3 electrically connected with the connector 1, a protective case 4 molded around an outer periphery of the circuit board 2, a light pipe 5 sheathed on an outer periphery of the connector 1, the circuit board 2 and the protective case 4, and an outer casing 6 sheathed on an outer periphery of the light pipe 5. The cable 3 extends rearward out of the outer casing 6.

The connector 1 comprises an insulating body 11, four conductive terminals 12 provided in the insulating body 11, and a shielding shell 13 sheathed on an outer periphery of the insulating body 11. The four conductive terminals 12 each have a soldering portion which extends rearward out of the insulating body 11. The shielding shell 13 is provided with a grounding soldering leg 131 which extends rearward. The grounding soldering leg 131 is substantially flush with the four soldering portions of the four conductive terminals 12. In the embodiment, the four conductive terminals 12 include one power terminal and a grounding terminal.

The circuit board 2 is provided behind the connector 1, and is electrically connected with the two conductive terminals 12 of the connector 1. An upper surface and a lower surface of the circuit board 2 each are provided with a light-emitting element 21. In the preferred embodiment, the light-emitting element 21 is a LED. The circuit board 2 is provided with two solder pads 22. The power terminal and the grounding terminal of the connector 1 are directly soldered on the two solder pads 22, respectively. Thus when the cable connector assembly is powered by a power supply, the light-emitting element 21 connects with the power supply via the connector 1 and emits light.

The cable 3 has five wires 31, where the four wires 31 are electrically connected with the four soldering portions of the four conductive terminals 12 of the connector 1, respectively, and the other one wire 31 is electrically connected with the grounding soldering leg 131 of the shielding shell 13. In the preferred embodiment, the four wires 31 of the cable 3 are directly soldered on the four soldering portions of the four conductive terminals 12 of the connector 1, respectively. This connection manner can simplify conductive path design on the circuit board, so as to reduce design difficulty and manufacturing costs. The other one wire 31 of the cable 3 is directly soldered on the grounding soldering leg 131. In other embodiments not shown in the Figures, it may also provide several conductive paths on the circuit board 2, that is, the circuit board 2 is provided with solder pads (not shown in Figures) at the front of the circuit board and the conductive terminals 12 are soldered to the solder pads provided at the front of the circuit board, and the circuit board is provided with solder pads (not shown in Figures) at the rear of the circuit board 2 and all the wires 31 or some wires 31 of the cable 3 are directly soldered to the solder pads provided at the rear of the circuit board 2, so that the wires 31 are electrically connect with the conductive terminals 12 via the conductive paths on the circuit board 2.

The protective case 4 is preferably in constitute of a layer of hot melt material which is molded around the outer periphery of the circuit board 2. The protective case 4 wraps up the joint of the wires 31, the conductive terminals 12 and the circuit board 2 therein, so as to provide a necessary protection, and prevent the soldered joint from being damaged when the cable 3 is subject to an external pulling force. It is noted that, in order not to affect the light-emitting effect, the light-emitting element 21 is exposed out of the protective case 4.

The light pipe 5 is made of a light transmitting material, the light pipe 5 can transmit the light emitted from the light-emitting element 21. The light pipe 5 is in a hollow cylindrical shaped, the inside of the light pipe 5 is formed with a first receiving cavity 59 penetrating the light pipe 5 along a front-rear direction, the first receiving cavity 59 can receive the connector 1, the circuit board 2 and the protective case 4 therein, so as to provide protection and make the light emitted from the light-emitting element 21 adequately incident to the light pipe 5. In the embodiment, an inner wall of the first receiving cavity 59 of the light pipe 5 is attached to the light-emitting element 21, so as to get better light transmitting effect. A front edge 51 of the light pipe 5 protrudes forwardly and is exposed out of a front end of the outer casing 6. The light emitted from the light-emitting element 21 is transmitted by the light pipe 5, can emit outwardly via the front edge 51 of the light pipe 5, so as to provide an indication that the cable connector assembly is in working status, and increase aesthetic perception of the product. In addition, the light pipe 5 is provided with a stop portion 52 which is annular and protrudes outwardly behind the front edge 51.

The outer casing 6 comprises a first insulating casing 61 and a second insulating casing 62 which are latched each other, the first insulating casing 61 and the second insulating casing 62 face each other in the front-rear direction. An upper side of the first insulating casing 61 is provided with two elastic latching arms 611 extending rearward, and a lower side of the first insulating casing 61 is provided with two elastic latching arms 611 extending rearward, the second insulating casing 62 is provided with four latching holes 621 corresponding to the four elastic latching arms 611. The first insulating casing 61 and the second insulating casing 62 are combined to form a second receiving cavity 69. The light pipe 5 is received in the second receiving cavity 69, is clamped at the front of the light pipe 5 and the rear of the light pipe 5 from the front-rear and is partially exposed out of the outer casing 6. During assembling, it only required to exert a force to make the first insulating casing 61 and the second insulating casing 62 face each other in the front-rear direction and latched each other, so it is quite convenient in assembling. The stop portion 52 of the light pipe 5 is stopped by the first insulating casing 61, so as to avoid the light pipe 5 moving forwardly out from the second receiving cavity 69.

An assembling process of the cable connector assembly of the present disclosure generally comprises steps of: firstly, soldering the two soldering portions of the two conductive terminals 12 of the connector 1 onto the two solder pads 22 of the circuit board 2 respectively, and then soldering the five wire 31 of the cable 3 onto the connector 1; then molding the hot melt material around the outer periphery of the circuit board 2 to form the protective case 4; then sheathing the light pipe 5 onto the outer periphery of the connector 1, the circuit board 2 and the protective case 4 from rear to the front; finally, sheathing the second insulating casing 62 onto the outer periphery of the light pipe 5 from the rear, and sheathing the first insulating casing 61 onto the outer periphery of the light pipe 5 from the front, and making the first insulating casing 61 and the second insulating casing 62 latched each other to form the outer casing 6.

In the cable connector assembly of the present disclosure, the light pipe 5 is sheathed on the outer periphery of the connector 1 and the circuit board 2, and the outer casing 6 formed by the first insulating casing 61 and the second insulating casing 62 which are latched each other is sheathed on the outer periphery of the light pipe 5, the structure of the cable connector assembly is simple and the assembling of the cable connector assembly is convenient.

The above contents are only embodiments of the present disclosure and are not used to limit the implementing solutions of the present disclosure. Those skilled in the art may conveniently vary or modify based on the main concept and spirit of the present disclosure, therefore the extent of protection of the present disclosure shall be determined by the terms of the Claims.

What is claimed is:

1. A cable connector assembly, comprising:

a connector which has an insulating body and a plurality of conductive terminals fixed in the insulating body;

a circuit board which is provided behind the connector, is electrically connected with at least two of the conductive terminals, and is provided with at least one light-emitting element;

a cable which has a plurality of wires, the conductive terminal being electrically connected with the wire;

a light pipe, the inside of the light pipe being formed with a first receiving cavity, the first receiving cavity receiving the connector and the circuit board therein; and an outer casing, the outer casing comprising a first insulating casing and a second insulating casing which are latched each other, the first insulating casing and the second insulating casing being combined to form a second receiving cavity, wherein the light pipe is received in the second receiving cavity and is partially exposed out of the outer casing, and wherein light emitted from the light-emitting element is able to emit outwardly via the light pipe, and wherein the cable extends rearward out of the outer casing.

2. The cable connector assembly according to claim 1, wherein the light pipe is in a hollow cylindrical shape, a front edge of the light pipe is exposed out of a front end of the outer casing.

3. The cable connector assembly according to claim 2, wherein the first insulating casing and the second insulating casing face each other in a front-rear direction, two sides of the first insulating casing each are provided with at least one elastic latching arm extending towards the second insulating casing, the second insulating casing is provided with at least two latching holes each corresponding to the elastic latching arm.

4. The cable connector assembly according to claim 3, wherein the light pipe is clamped between the first insulating casing and the second insulating casing in the front-rear direction, the light pipe is provided with a stop portion which protrudes outwardly behind the front edge of the light pipe and is stopped by the first insulating casing.

5. The cable connector assembly according to claim 1, wherein an inner wall of the first receiving cavity of the light pipe is attached to the light-emitting element.

6. The cable connector assembly according to claim 1, wherein the light-emitting element is a LED.

7. The cable connector assembly according to claim 1, wherein the circuit board is provided with two solder pads, and the conductive terminals of the connector comprise a power terminal and a grounding terminal which are directly soldered on the two solder pads respectively.

8. The cable connector assembly according to claim 1, wherein the wires of the cable are directly soldered on the conductive terminals of the connector.

9. The cable connector assembly according to claim 1, wherein the connector further comprises a shielding shell sheathed on an outer periphery of the insulating body, the shielding shell is provided with a grounding soldering leg extending rearward; one wire of the cable is directly soldered on the grounding soldering leg.

10. The cable connector assembly according to claim 1, wherein a protective case is molded around an outer periphery of the circuit board, the protective case wraps up at least joint of the wires, the conductive terminals and the circuit board therein, and the light-emitting element is exposed out of the protective case.

* * * * *